United States Patent [19]

Brunner

[11] Patent Number: 4,911,441

[45] Date of Patent: Mar. 27, 1990

[54] APPARATUS FOR CONTROLLING MOVES OF A BALL-HITTING INSTRUMENT IN BALL GAMES

[76] Inventor: Adolf Brunner, Baslerstr, 37, 7800 Bad Säckingen, Fed. Rep. of Germany

[21] Appl. No.: 67,726

[22] Filed: Jun. 23, 1987

[30] Foreign Application Priority Data

May 18, 1987 [EP] European Pat. Off. ..... 87810302.7

[51] Int. Cl.[4] ..... A63B 61/00

[52] U.S. Cl. ..... 273/29 A; 273/73 R; 273/26 B; 273/54 B; 273/186 R; 273/186 A; 273/183 B

[58] Field of Search ..... 273/73 R, 54 B, 186 R, 273/186 A, 183 R, 183 B, 26 C, 29 A

[56] References Cited

U.S. PATENT DOCUMENTS 3,766,538 10/1973 Dealy ..... 340/279
3,788,647 1/1974 Evans ..... 273/186 A
4,094,504 6/1978 Barasch ..... 273/29 A
4,330,123 5/1982 Kleinerman ..... 273/54 B
4,515,368 5/1985 Pititjean ..... 273/186 A
4,535,986 8/1985 Richards ..... 273/29 A

*Primary Examiner*—Edward M. Coven
*Assistant Examiner*—Dean Small
*Attorney, Agent, or Firm*—Wells & White

[57] ABSTRACT

A ball-hitting instrument for playing ball games, comprises a handle and a flat head part (preferably a tennis racket bearing a screen in the head part) and an apparatus for programming and controlling the seizing of the handle and the guiding of the instrument during a player's motions for hitting a ball. The apparatus is mounted on the handle and contains an electronic circuit comprising an on-off switch, a perceivable signals-emitting device such as a buzzer, an integrated circuit chip, a potentiometer and four noiseless, quick-response switches each having a travel path and a circuit-making mercury or magnetic body movable back and forth along that path to make or break circuit.

24 Claims, 9 Drawing Sheets

FIG. 5 (SHEET 1 of 2)
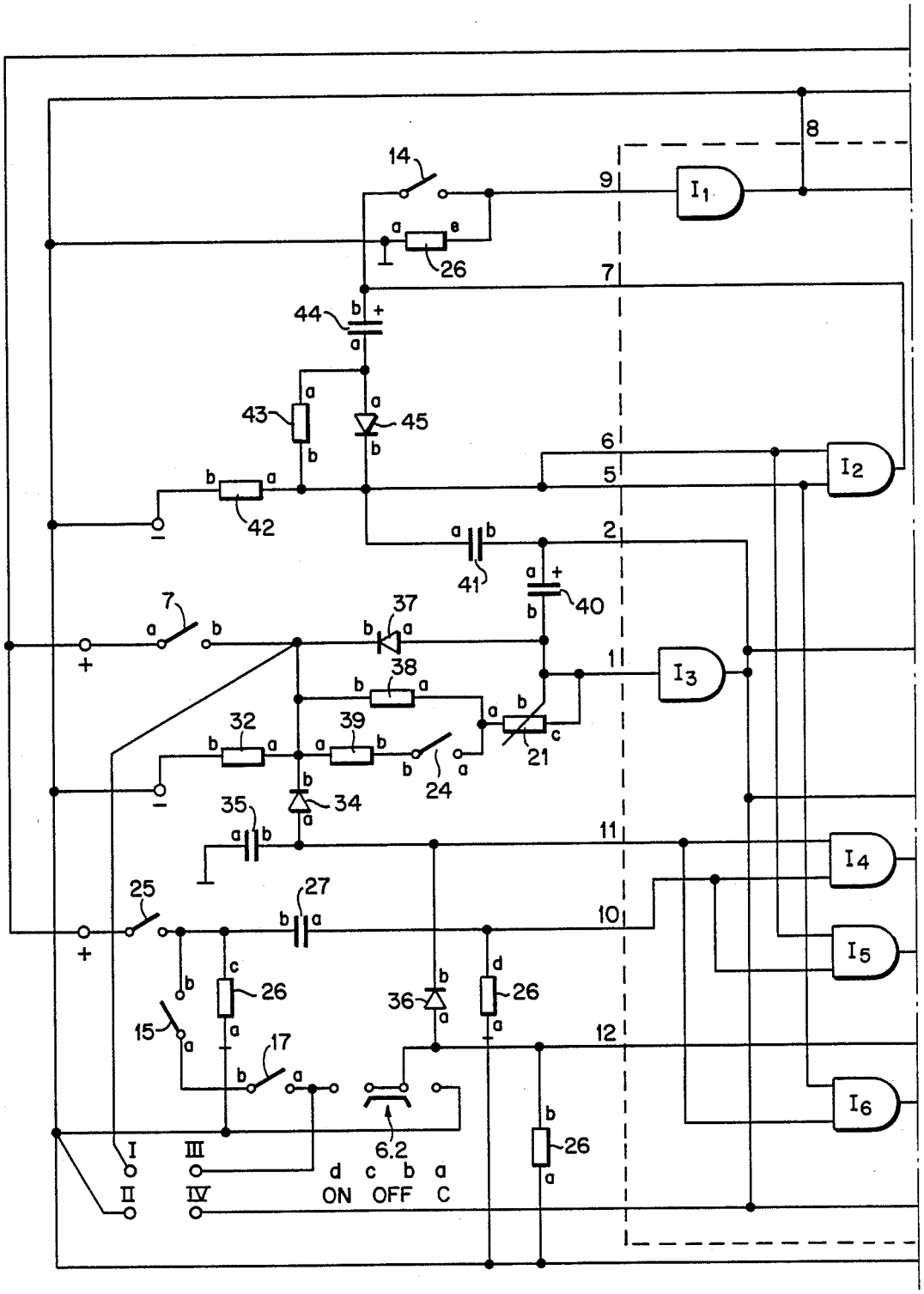

FIG. 5 (SHEET 2 of 2)
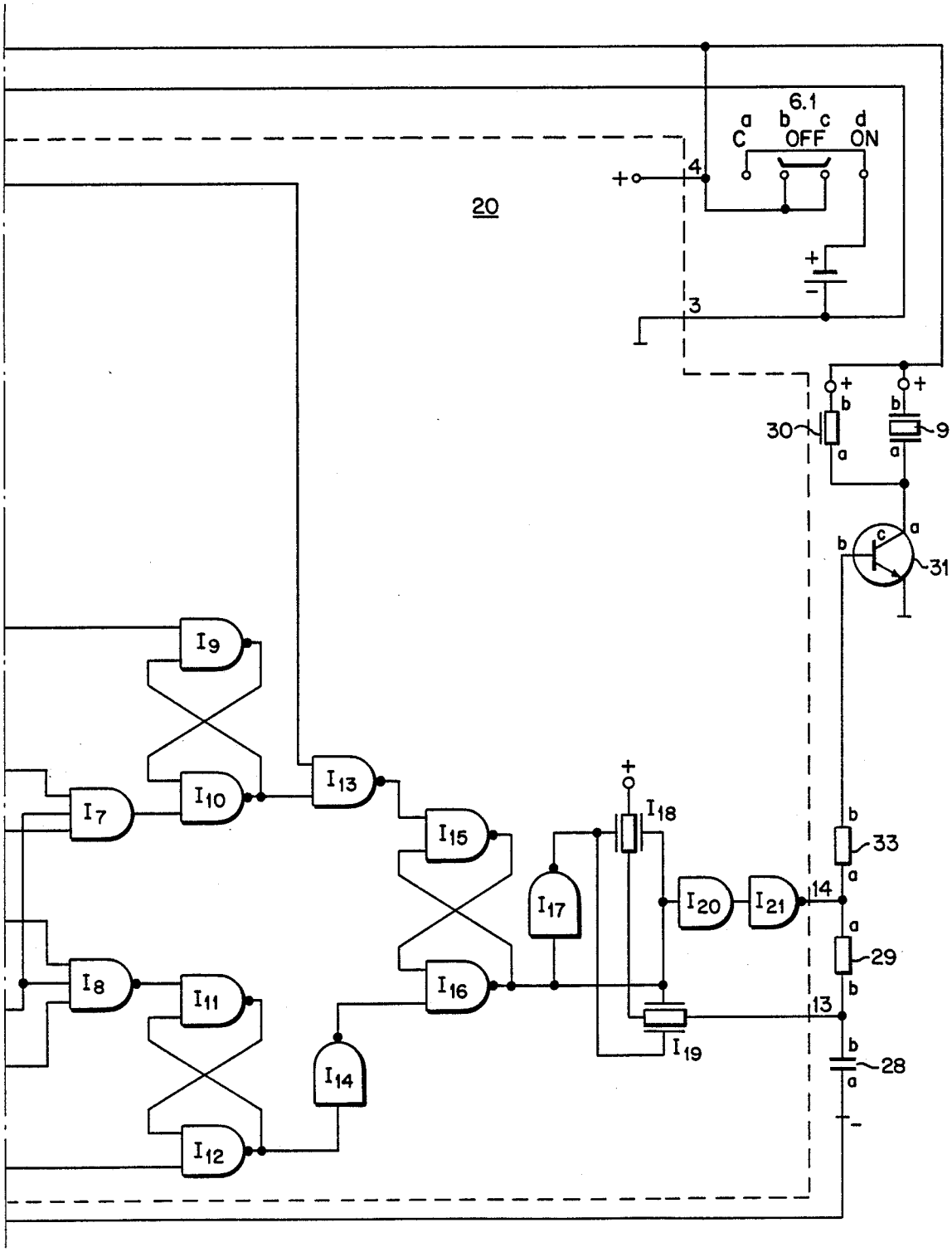

APPARATUS FOR CONTROLLING MOVES OF A BALL-HITTING INSTRUMENT IN BALL GAMES

BACKGROUND OF THE INVENTION

This invention relates to an apparatus for programming and controlling the position of the handle of a ball-hitting instrument or "bat" and the guidance of the instrument in ball games.

Such instruments are in particular, a club, lofter or putter for playing golf, a stick for playing hockey, a bat or willow for playing cricket or a racket for playing badminton or, in particular, tennis.

In ball games which require an instrument for hitting the ball, the seizing position of the player's hand on the bat handle and the guidance of the bat when carrying out the necessary motions, leading to and including the hitting movement or strike by the player's arm, is of paramount importance if an unobjectionable dynamics and rhythmics of all the phases of the bat movements are to be obtained.

Non-rhythmic motional sequences require a greatly increased motive force and excessive consumption of energy, and the rate of errors made by the player increases more than would be proportional with the increase of power input. For instance if the transition from the "swing-out" to a striking or hitting motion is not carried out dynamically, much more energy is used up by the player than when he plays correctly, and he will become tired much sooner in a ball game and tend to lose it.

In the German Offenlegungsschrift 35 25 843 there is described a control apparatus which is intended to control certain phases of forehand and backhand play, slicing and service and other motions particularly connected with playing tennis.

However, the entire sequence of phases is not controlled by this device but only certain phases of a complete rhythmic play. Moreover, this known device suffers from several drawbacks. A most serious drawback of the known device is to be seen in that the response of signal-emitting electronic units is too slow so that the signals arrive too late to be processed timely. Another serious drawback resides in the necessity for the player to operate switches in the middle of a play in order to distinguish between forehand and backhand moves, as the known device cannot automatically distinguish between them. Yet another serious drawback resides in the fact that the limits that must be observed by a player in order to obtain a "good signal" toward the end of a move, are so narrow that a player must be practically perfect, so that a trainee never achieves a "good" result except incidentally.

A further drawback is to be seen in the rattling noise produced continuously by certain switch means in the known device, and a further one in the large number of switches required for an incomplete control of motions. In this connection another drawback resides in the fact that switch means that would be required to switch from a normal forehand or backhand play to slicing moves could not be technically realized.

OBJECTS AND SUMMARY OF THE INVENTION

It is therefore an object of the invention to provide an apparatus for programming and controlling the complete sequence of motional phases during forehand moves, backhand moves and service of a ball when executing a ball game involving the use of a bat rhythmically with correct timing.

It is another object of the invention to provide an apparatus for the programming and controlling of motional phases in the execution of a ball game involving the use of a bat, of which the apparatus is adapted to inform the player or an instructor in an easily recognizable manner whether the player's consecutive motions are carried out without error, thus affording a dynamic and rhythmic play with optimal utilization of energy.

It is yet another object of the invention to provide a control apparatus of the type described and adapted for attaining the foregoing objects with a minimum of signal-emitting switch elements, responsive rapidly to all movements of a bat, and which do not hinder or disturb the player in carrying out a normal ball game, particularly without hearing a disturbing noise during the phases of a move leading to a ball-hitting forward strike, and without having to operate any switches in the middle of a sequence of motions.

These objects are attained in accordance with the invention by an apparatus for the programming and controlling of the seizing position and the guidance of a ball-hitting instrument, which apparatus comprises integrated ciricuit chip means which may comprise a microchip for controlling only, or a microprocessor and analog digital converter, switching and control means adapted to respond to the entire rhythm of the sequence of movements of the ball-hitting instrument, means for programming the motional sequence of the entire rhythmics of the ball-hitting instrument, means for controlling the run-off of the program, and means for producing an easily noticeable signal indicating at least one of the correct and incorrect motional sequences of the entire rhythmics of the ball-hitting instrument.

Thereby, the control of the entire rhythmics of hitting a ball during a ball game using a ball-hitting instrument is so controlled that a player is assisted in adopting a correct seizing position of a player's hand seizing the instrument and a correct guidance of that instrument during all movements leading to the striking of a ball, by perceivable signalization.

The term of "entire rhythmics" of hitting a ball designates the harmonic execution of individual motions in an entire motional sequence when playing ball games using ball-hitting instruments.

The individual motions of the strike sequence, i.e. the rhythmics of striking the ball to be programmed in the apparatus according to the invention, controlled and signalized as mentioned above, are the following motions (a) to (e) applying to playing both forehand and backhand such as in tennis:

(a) the starting position in which the handle of the instrument is gripped by the player's hand and the angle in which the racket is held relative to the player's lower arm;

(b) the direction and length of the rearward swinging-out motion with continuous control of the guiding of the racket by the player's hand and of the way in which the player's hand grips the handle;

(c) the end of the swinging-out phase with adjustable control of timing;

(d) the beginning of the foreward strike phase with control of timing; and (e) the execution of the striking motion with momentum or velocity control.

The following motions (f) to (k) apply to the service of a ball in such games as tennis:

(f) the starting position in which the handle of the instrument is gripped by the player;

(g) the direction and length of the swing-out with controls similar to those applied under (b), supra;

(h) the end of the swinging-out phase and transitional phase toward the downward strike to serve the ball;

(i) the beginning of the striking phase with control of the timing; and (k) the execution of the striking motion for serving the ball.

Owing to the fact that the apparatus according to the invention is based on microelectronic features, it can be installed in a very small space, preferably on or in the handle of a ball-hitting instrument such as a tennis racket.

One advantageous feature of the apparatus according to the invention resides in the possibility of adjusting the program to the anatomy of a particular player.

It is believed that the apparatus according to the invention permits for the first time to detect errors in the entire rhythmics of a ball game, using a ball-hitting instrument, by microelectronic means in combination with a signal-emitting switch system for controlling the execution of a player's moving of the instrument, and for signalizing a faulty execution.

In the simplest embodiment of the apparatus according to the invention which serves for controlling only the execution of an entire rhythmic motion sequence of forehand or backhand play, or of service, in accordance with a fixed program, executed by a player irrespective of whether he is right-handed or left-handed, the integrated ciricuit chip means is a gate-array chip.

This applies particularly to tennis. The change from using a racket containing the apparatus according to the invention for service instead of forehand or backhand play is effected by the player turning the racket in his hand by 180° from the position in which the racket must be held when playing forehand or backhand. Thus the manner in which the player must hold the racket is the same when playing either forehand or backhand. No switches need be actuated at all during all these movements.

In more sophisticated embodiments, the integrated ciricuit chip means is a single chip microprocessor or includes an analog digital converter, the apparatus according to the invention can be used not only for recalling a fixed program, but also for programming the above-mentioned motion sequences.

Besides emitting a perceivable "good" signal during the final phase of a motion-sequence if none of the phases thereof deviated from a previously entered program, the circuitry in the apparatus according to the invention can also comprise electronic means for emitting perceivable signals indicating when errors have been made by a player during a certain phase of a motion sequence, by deviating from a given program.

These signaling means which can be optional or acoustic ones, can be built in the apparatus in such a manner that they can be perceived either by the pupil or by the teacher exclusively, or by both.

Acoustic signals can be buzzing sounds, musical sounds or spoken language.

BRIEF DESCRIPTION OF THE DRAWINGS

Further objects and advantages of the invention will become apparent from the following more detailed description thereof in connection with the accompanying drawings in which:

FIG. 5 is a schematical circuit diagram of the embodiment of the control apparatus shown in FIG. 2;

DETAILED DESCRIPTION OF THE EMBODIMENTS SHOWN IN THE DRAWINGS

Figure 1:
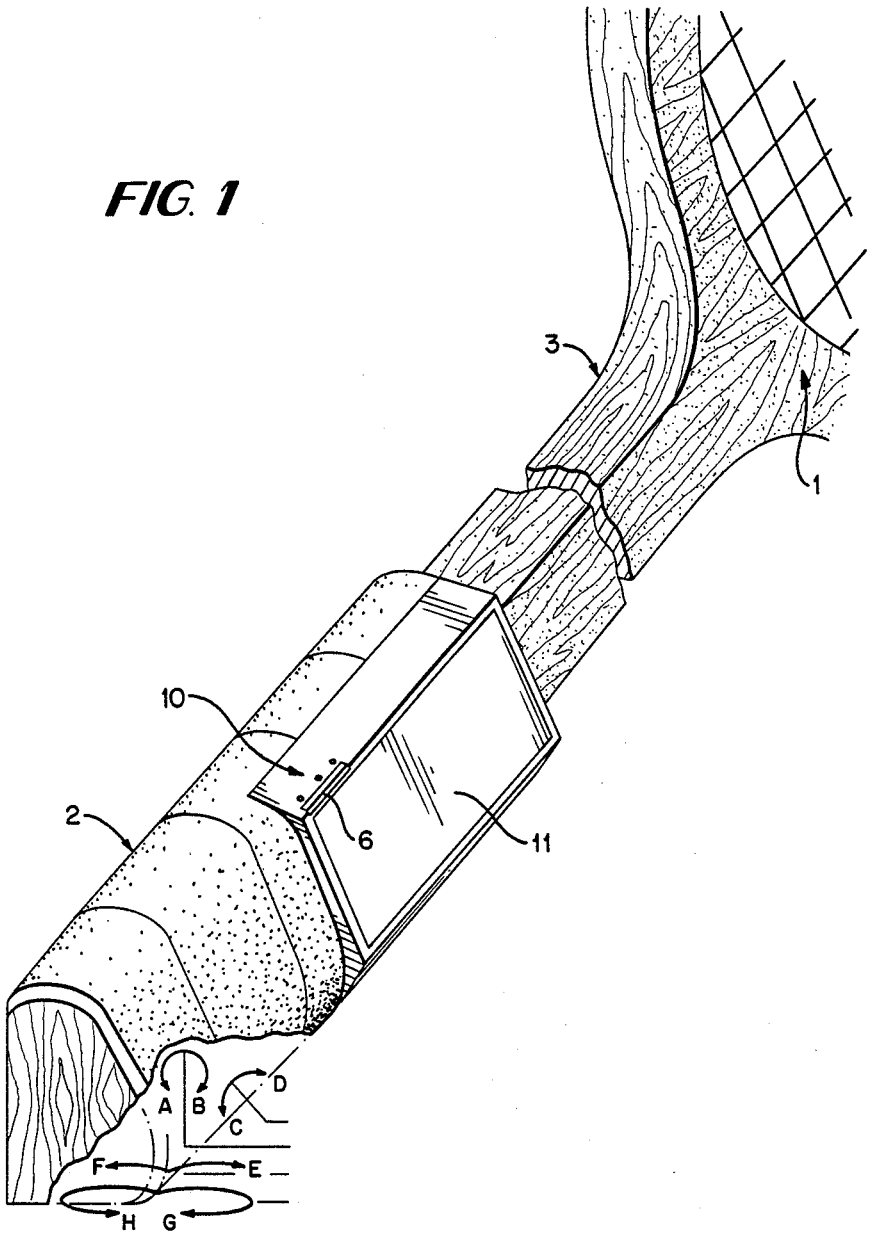
FIG. 1 is a side-view, in perspective, of a preferred embodiment of the apparatus according to the invention, mounted in the region of the neck of the handle of a tennis racket, arrows indicating deviations from a correct holding or guiding of the instrument.
Figure 2:
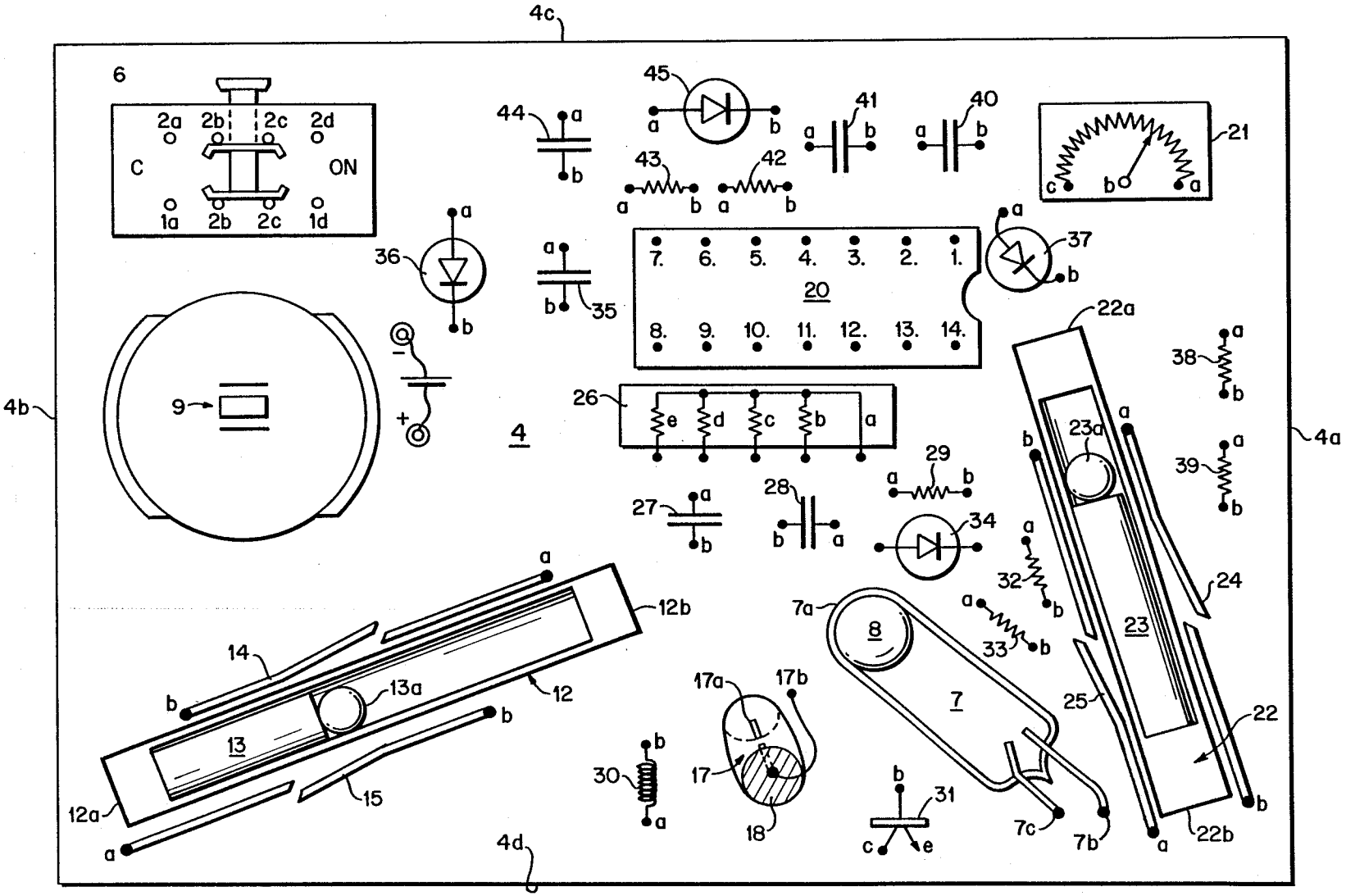
FIG. 2 is a schematical top-view of the embodiment of the apparatus shown in FIG. 1 with the lid of the casing removed.

The embodiment of the apparatus according to the invention shown in FIGS. 1 and 2 comprises a casing 10 having a removable cover or lid 11. The casing 10 is mounted in the racket handle 2 of a tennis racket having the screen-containing racket head 1 in a region near the racket neck 3.

The casing 10 is mounted in or on the handle 2 in a manner such that the lid 11 covering the upper face of a circuit board 4 is turned toward the right-hand side when a right-handed player holds the racket in the prescribed starting position for a forehand or backhand strike in which the player's lower arm should form an angle of 150° with the longitudinal axis of the racket handle 2, and the racket head 1 should be in upright position, i.e. the net therein should extend in a substantially vertical plane. As seen by the player holding the racket, the casing lid 11 faces away from the player to the right (See also position (a) in FIG. 3). The player may incline the upper portion of the racket head 1 slightly to the left as indicated by the arrow A in FIG. 1. A left-handed player would then hold the racket in exactly the same manner, so that the lid 11 of the casing 10 would again face to the right, which means that it would face toward the player.

In FIG. 2 there is shown the circuit board 4 which has become visible by removing the casing lid 11. The circuit board 4 has a longitudinal axis coinciding with, or being at least substantially parallel with the longitudinal axis of the racket handle 2 and has two opposite edges **4*a* and 4*b* transverse to, and two opposite longitudinal edges 4*c* and 4*d*** extending parallel with the longitudinal circuit board axis.

The casing 10 of the apparatus is mounted in or on the racket handle 2 in a manner such that the board extends in the same plane as the screen in the racket head, and that the transverse edge 4a is on the side of the racket head 1 and the other transverse edge 4b is located toward the free end of the racket handle 2, while the edge 4c which will then extend parallel with the longitudinal axis of the racket handle 2 is the upper circuit board edge, and correspondingly the longitudinal edge 4a is the lower edge of the circuit board 4 when the racket is held by the player in the prescribed position for carrying out a forehand or backhand sequence of motion phases.

The circuit board 4 bears on its outer face the following electronic elements:

an on-off-switch 6 which has preferably a third or control position C must be turned on if the apparatus and in particular the battery 5 therein is to be checked for operativeness for instance, a switch of the type MMS-25-R, sold by Augert GmbH, D-8000 München, is recommended for use;

a perceivable signals-emitting device 9, in the instant case a device which will emit an audible signal, for instance, a buzzer of the type Piezo-PCS 15 sold be Endrich Vertriebs GmbH, D-7270 Nagold; it can also be replaced by an optical signal emitter;

a microchip 20; for instance, a chip No. 9005-021 having the following properties: minimum 1 volt, maximum 1 to 8 volt, feed current 1 microère, maximum current 0.2 milliampère, oscillation frequence minimum 1 kilocycle, maximum 10 kilocycles, manufactured and sold by Eurosil Electronic GmbH, D-8057 Eching, can be used;

a potentiometer 21; for instance, a potentiometer in the range of from 200 to, optionally, 500 kiloohm such as No. 3386 X-001-204 sold by Sasco, D-8500 Nürnberg is recommended;

an elongated mercury switch 7 containing a body of mercury 8 and having an inner end 7a and an outer contact-making and breaking end with pole pins 7b and 7c. This first mercury switch 7 is mounted so that the outer end, with pole pins 7b and 7c, is nearer the board edge 4a extending transversely to the longitudinal board axis than the other mercury switch end 7a and the longitudinal axis of the elongated mercury switch 7 intersects the longitudinal board axis at an angle of about 40°; for instance, a mercury switch of the type A 167/2 TC sold by Günther GmbH, D-8500 Nürnber is recommended;

a second elongated mercury switch 17 containing a mercury body 18 and having an inner contact pin 17a' and an outer contact pin 17b' and being mounted at its inner switch end 17a on the outer board face so that it projects from that face upward at a substantially right angle; for instance a mercury switch of No. 2803, sold by Günther GmbH, supra, is recommended;

a third switch 12 having an elongated tubular magnetic track for switching operation containing a permanent magnet body 13 slidable in the tubular track 12 between an outer or rearward and an inner or forward end 12a and 12b, respectively, at which the permanent magnet inductively acts upon a reed 15 or a reed 14, respectively. This magnetic track (switch 12) is mounted on the outer face of the circuit board 4 to extend with its longitudinal axis parallel therewith and intersecting the longitudinal board axis at an angle of about 20°, the inner end 12b of the track 12 being nearer the first board edge 4a than the outer end 12a; for instance, as a permanent magnet body 13, there is recommended No. 4268-1 sold by Magnetfabrik Bonn, D-5300 Bonn am Rhein; this magnet is in the shape of a cylindrical body having a diameter of about 2.5 mm and a length of about 8 mm; the magnet is armed at the end facing toward the track end 12b with a steel ball having a diameter of 2.5 mm and being sold by Denkhaus, D-8500 Nürnberg; the length of the track along which the magnet body can travel is preferably 20 mm; a fourth switch 22 having an elongated tubular magnetic track for switching operations containing a permanent magnet body 23 slidable in the tubular track 22 between an inner, rearward end 22a and an outer, forward end 22b, respectively; in an intermediate region therebetween, the permanent magnet 23 inductively acts upon a pair of reeds 24 and 25, simultaneously. This magnetic track 22 is mounted on the outer face of the circuit board 4 to extend with its longitudinal axis parallel therewith and intersecting the longitudinal board axis at an angle of about 75°, the outer end 22b of the track of magnetic switch (22) being nearer the first board edge 4a than the inner end 22a; for example, the same ball-armed kind of magnet is preferred as used in the magnetic switch 12; however, the length of the free track in this case is 18 mm and the length of the magnet body is 12 mm not counting the ball.

Further electrical elements mounted on the outer face of the circuit board 4, whose function will be explained further below are the following:

a resistor array 26, comprising four 100 kiloohm resistors arranged single in line with one common exit; sold, for instance, by Neutronic Components, Frank Peter Neumann, D-8038 Grötenzell;

a first capacitor 27, preferably of 10 nanofarad; a ceramic capacitor, sold by Frank Elektronik GmbH, 8500 Nürnberg, is recommended;

a second capacitor 28, preferably of 2.2 nanofarad; available from the same manufacturer;

a first single resistor 29, preferably of 100 kiloohm; available from the same source as the reistor array 26;

an electrical coil 30, preferably of about 20 to 30 millihenries; for instance, An 25 or AN 27, sold by Endrich Vertriebs GmbH, supra, is recommended;

a transistor 31, preferably of the emitting type; for instance, type BC 546 A, sold by Neutronic Components, supra;

a second resistor 32, preferably of 10 kiloohm, sold for instance by Neutronic Components, supra;

a third resistor 33, preferably of 4.7 kiloohm; sold for instance by Neutronic Components, supra;

a first diode 34, preferably a silicon diode having a forward voltage smaller than 0.7 volt; for instance, a diode of the type lN 4/48 or lN 914 sold by Neutronic Components, supra, is recommended;

a third capacitor 35, preferably of 47 nanofarad, sold, for instance, by Neutronic Components, supra;

a second diode 36; the same kind as the diode 34 can be used;

a third diode 37; the same kind as the diode 34 can be used;

a fourth resistor 38; preferably of 680 kiloohm, sold, for instance, by Neutronic Components, supra;

a fifth resistor 39; preferably of 330 kiloohm, sold, for instance, by Neutronic Components, supra;

a fourth capacitor 40; preferably a tantalum capacitor of 1.5 microfarad and a forward voltage of preferably 20 volt, but also of 1 microfarad, 1 to 2.2 microfarad, and 2.2 microfarad, available, for instance, from Neutronic Components, supra;

a fifth capacitor 41, preferably of 10 nanofarad and a forward voltage of preferably 50 volt or more, available, for instance, from Neutronic Components, supra;

a sixth resistor 42, preferably of 820 kiloohm, available, for instance, from Neutronic Components, supra;

a seventh resistor 43, preferably of 1 megaohm, available, for instance, from Neutronic Components, supra;

a sixth capacitor 44, preferably of 40 nanofarad and a forward voltage of about 20 volt, available, for instance, from Neutronic Components, supra; capacitors of 1 microfarad, 1 to 1.2 microfarad and 2.2 microfarad can also be used in conjunction with corresponding capacitor 40; and a fourth diode 45, preferably a germanium diode having a forward voltage of less than 0.3 volt at a current intensity below one milliampère; for instance, one of the diodes Nos. AA 112, AA 113, AA 115 or BAT 41, sold by Neutronic Components, supra, can be used.

Figure 6:
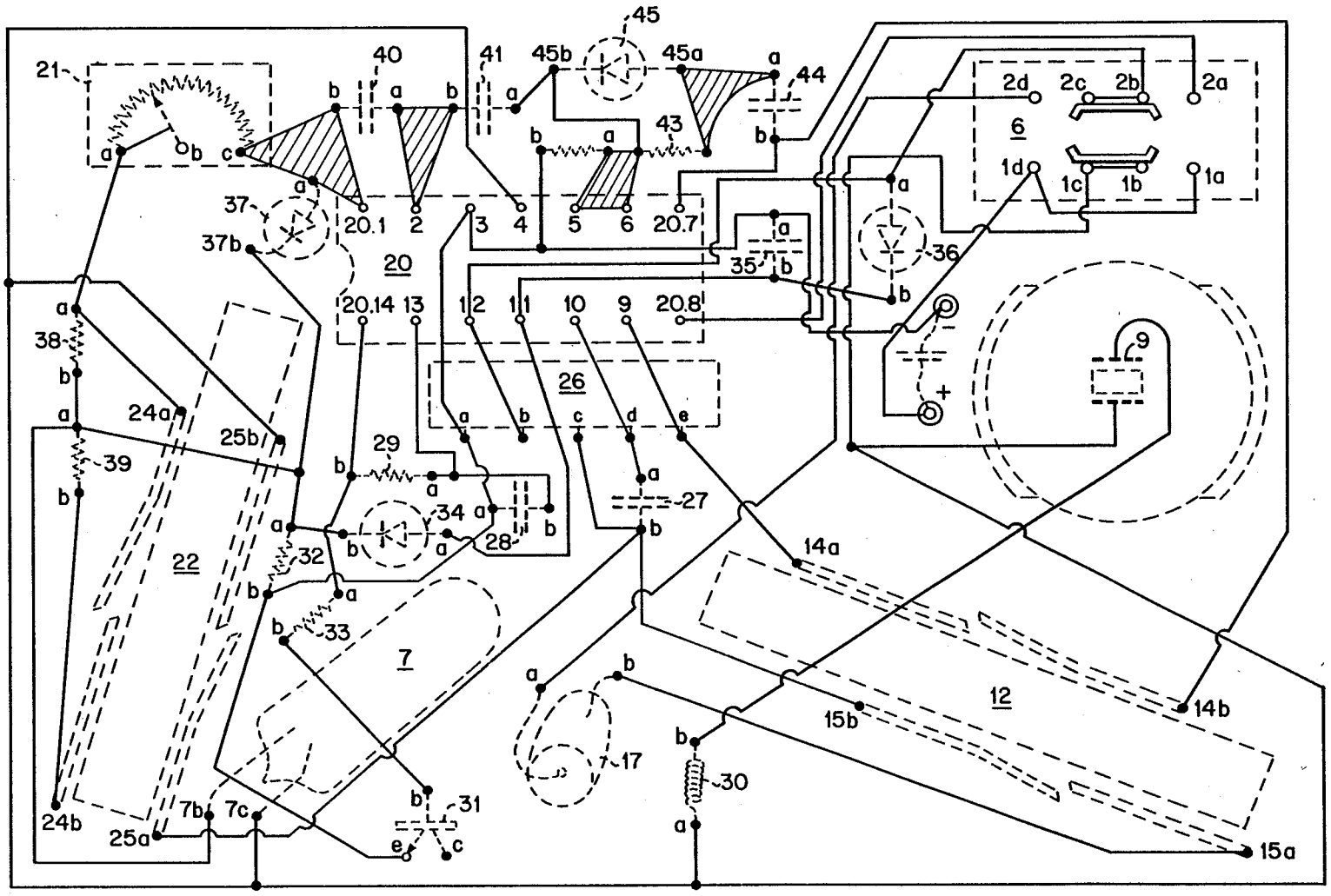
FIG. 6 shows the wiring of the underside of a circuit board bearing on its upper side the electrical main elements shown in FIG. 2.

The circuitry by which the above described main switching components are interconnected is preferably a printed circuit on the underside of the circuit board 4 as shown in FIG. 5 and particularly FIG. 6. This circuitry will be explained further below.

Figure 3:
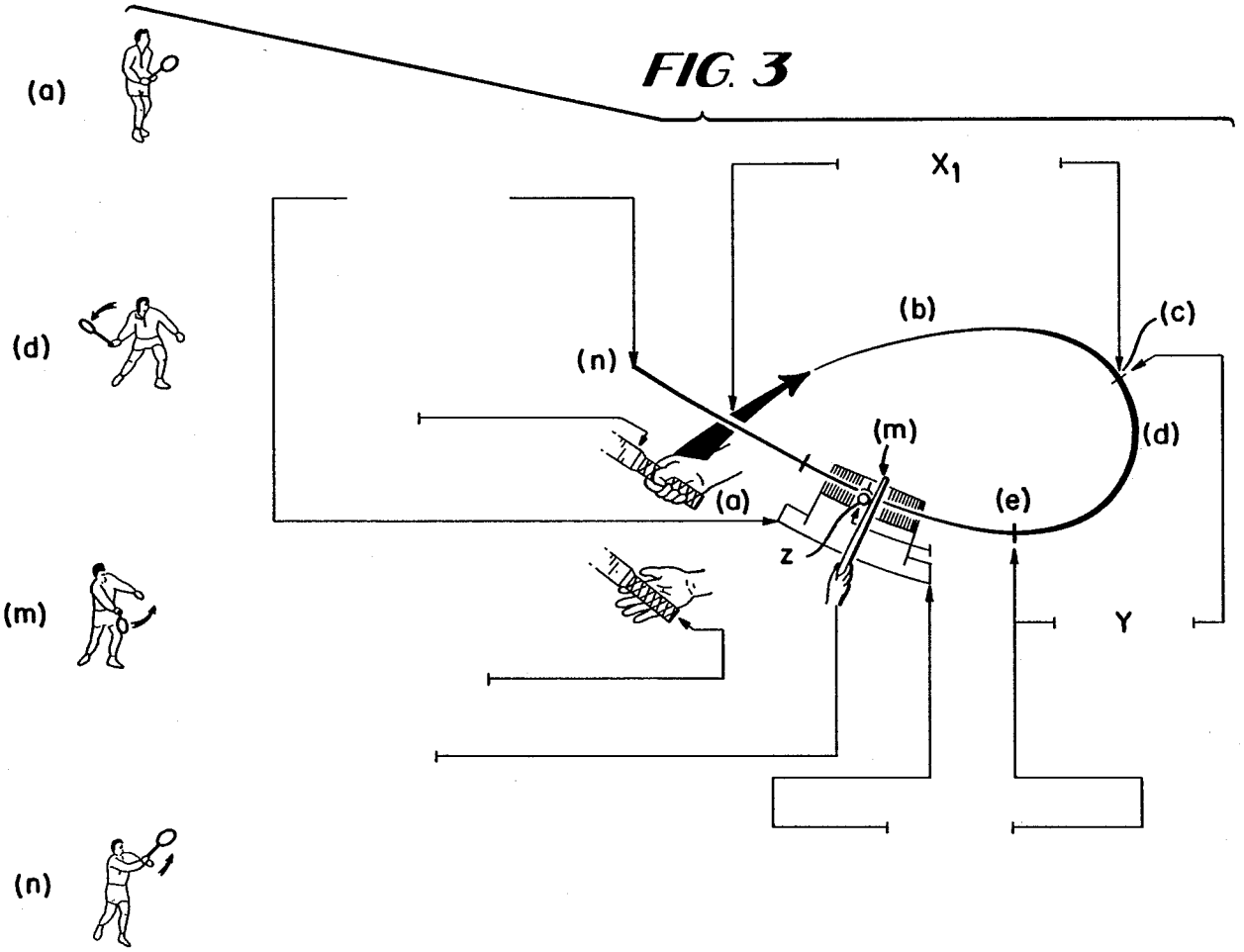
FIG. 3 is a diagram showing the sequence of motions carried out, and the timing controls during, certain phases of a forehand sequence of motion phases.
Figure 4:
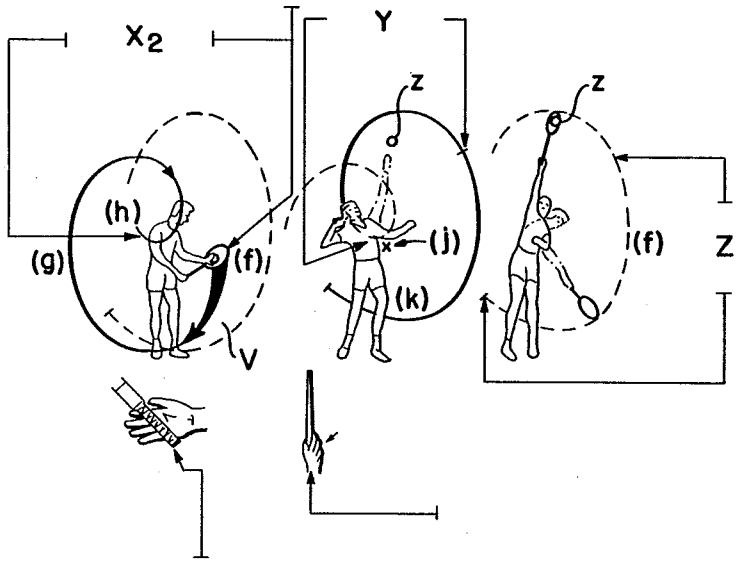
FIG. 4 is a diagram showing the sequence of motions carried out, and the timing controls during, certain phases of serving a ball in a tennis game.

The various phases controlled by the apparatus according to the invention will now be briefly explained having reference to FIGS. 3 and 4.

In FIG. 3 there are shown the phases which are common to a complete rhythmic motion during a forehand as well as a backhand play. These phases are, moving away from a starting position (a), a laterally rearward, upward or horizontal swing-out phase (b) which should be accomplished, if correctly played, within a time interval $X_1$, as indicated in FIG. 3, till the end (c) of the swing-out phase is attained which merges with a rhythmic transitional phase (d) in which the forward strike phase must be initiated within a fixed time interval Y and the forehand or backhand play is completed by a striking phase beginning at (e) at which point in time the racket should be accelerated to its full striking motion before hitting the ball z at the point in time (m) and afterwards fading out the striking phase to end the move at the point in time (n).

The service shown in FIG. 4 comprises the phases beginning from a starting position (f). When using the racket for carrying out a service, the racket must be turned through an angle of 180°, i.e. the racket handle must be seized by a right-handed person in a manner such that the lid 11 and the printed circuit thereunder is on the inside, as seen by the player, facing toward him instead of away from him toward the outside, as would be the case in the movements described hereinbefore. Through a downward and rhythmically following upward swing-out (g) during a time interval $X_2$, which ends a short time before the racket is at the player's back in position (h) whereupon the player begins a rhythmic transition to the striking phase at the point in time (i) with an acceleration which should begin in the time interval Y. The ball z should be hit preferably before the time interval Y ends, while the strike phase (j) is being executed and the player then fades out his strike during a phase (k).

The control apparatus according to the invention permits the player to be given a perceivable signal, preferably a continuous sound from the buzzer in the apparatus during the striking phase as soon as the latter has begun during the transition phase (d), lasting to the end of the fade-out (n), if all previous phases of the forehand or backhand play were carried out satisfactorily. Likewise, such a perceivable signal will be given the player during the entire striking phase (j) and fade-out (k).

It is also possible to give temporary signals during or at the end of individual phases whenever these have not been carried out correctly, so that a player can attempt to improve his play until he receives the "good" signal at the beginning of the forward strike phase.

According to another feature of the invention, the magnetic switches 12 and 22 comprise, in combination with their permanent magnets 13 and 23, respectively, weight-increasing means such as steel balls 13*a* and 23*a* (FIG. 2). These balls have an accelerating effect on the magnets, whether they are moved from an inner to an outer end position or viceversa, when closing or opening reeds 14,15 or 24 and 25, associated with the magnetic switches. Particularly, they help to overcome "sticking" of the magnets in their tracks due to inductive influences of the closed reeds.

The switches used in the circuitry of the apparatus according to the invention must be "elongated" in the sense that the circuit-making mercury or magnet or the like elements must travel a straight or curved path of a certain length between a first and a second, third or more positions, in order to make or break circuit, while in the case of the mercury switch 17 the mercury body 18 must travel from either end position in the switch glass tube to a third, central position intermediate the two end positions in order to make circuit.

The angles which are enclosed between, e.g. the magnetic switch tracks 12 and 22, respectively, and the longitudinal axis of the circuit board 4 can vary by about ±10° to ±20° from the preferred angles mentioned.

Functions of the four main switching components

There shall now be explained the various functions fulfilled by the above-mentioned four main switching components, namely the mercury switch 7, the mercury switch 17, the third switching component comprising the magnetic track (12) and permanent magnet body 13, as well as the reed switches 14 and 15, and the fourth switching component comprising the magnetic track (22) and permanent magnet body 23 as well as the two reed switches 24 and 25.

(I) The mercury switch 7 is capable of fulfilling the following functions:

(1) In the correct starting position, in which the angle between the racket handle 2 and the player's lower arm is about 150°, the mercury body 8 is in the position 7*a* of the switch 7, i.e. this switch is open, because there is no conductive connection between the pole pins 7*b* and 7*c* at the opposite end of the switch.

(2) If the angle between the racket handle 2 and the player's lower arm is too large, for instance, 200° to 250°, the mercury 8 will run from the end 7*a* of the switch 7 to its opposite end with pole pins 7*b* and 7*c* and will close the switch 7 too early. The time interval $X_1$ will then begin to run even before any swing-out phase has been started by the player, and the entire motion control of the apparatus will be out of order.

(3) If the above-mentioned angle is too small, for instance 90° (flower bouquet position), the mercury body 8 will remain in the end position 7*a* of the switch 7 at least initially and possibly throughout the entire swing-out phase (b) and the time interval $X_1$ will begin to run too late or not at all.

(4) The functions of the mercury switch 7 are the same when playing forehand and when playing backhand. During the lateral swing-out phase (b) centrifugal forces move the mercury body 8 to the end position 7*b*, 7*c* and close the switch. The switch 7 would not be closed if the swing-out was vertically upward.

(5) During rhythmic transition, free from interruptions, the mercury body 8 will remain in the switch-closing position bridging pole pins 7*b* and 7*c* and will continue in this position during the entire forward strike.

(6) An interruption of the rhythmic motion at the end of the swing-out and before starting the transition phase (d) while still in the time interval $X_1$ would cause the mercury body 8 to drop back to the position 7*a* and open the switch 7, whereupon no "good" signal would be possible.

The buzzer will still sound even after the forward strike phase is forehand or backhand play and also during service has ended until the player returns the racket to the starting position and holds it again at the correct angle of approximately 150° relative to the player's lower arm.

(II) The mercury switch 17 is adapted for distinguishing between (i) Correct execution of a forehand play:

The forehand play comprises a swing-out from a correct holding of the racket with the screen in the racket head 1 extending in a vertical position or a position slightly tilted with its upper portion in the direction of arrow A (FIG. 1). The mercury body 18 in the switch 17 is found in the inner end position 17*a*.

During the transition phase, while in the time interval Y, the mercury body 18 shifts to the opposite, outward end position 17*b*, thereby emitting a signal which reports the beginning of the forward strike phase while still holding the racket head 1 and the screen therein in the correct position.

During the entire forward strike through (e) and (m), the mercury body 18 will remain in the outer end position 17*b* of the switch 17 until, after hitting the ball, the end (n) of the strike phase is reached.

(ii) Slightly incorrect forehand play:

At the beginning and throughout the swing-out phase the player holds the racket head 1 with the net therein in a plane slightly deviating in the direction of the arrow B (FIG. 1) from the vertical plane. The mercury body 18 then moves initially to the position 17*b* in the switch 17, and, under the centrifugal forces of the swing-out, the mercury body 18 enters a labil state between the end positions 17*a* and 17*b* and emits "swish"-signals (due to irregular, discontinuous pulses), which block the emission of a "good" signal.

(iii) Highly incorrect forehand play:

From the start and/or throughout the swing-out phase, the player holds the racket head 1 with the net therein extending in a plane which strongly deviates in the direction of the arrow B (FIG. 1) from the vertical plane, and the mercury body 18 remains steady in the outer end position 17*b*, because the centrifugal forces are not sufficient to move the mercury body 18 against its inerta toward the inner end position 17*a*, so that no signal indicating the beginning of a forward strike is emitted during the time interval Y, and consequently, no "good" signal can be emitted.

(iv) Correct backhand play:

The correct starting position in this case requires that the racket head 1 be held in such a manner that the screen in the racket head 1 extends in a vertical plane or deviates from this plane with the upper portion of the screen tilted slightly in the direction of the arrow B (FIG. 1). In this starting position the mercury body 18 is in the outer end position 17*b* and remains in the same throughout the swing-out phase.

In the transition phase the mercury body 18 shifts to the position 17*a* emitting a signal within the time Y, which signal indicates the beginning of the forward strike phase with acceleration.

During the entire forward strike phase the mercury body 18 remains in the end position 17*a* until, after hitting the ball, this phase ends at the point in time (n).

(v) Slightly incorrect backhand play:

From the start and through the swing-out the net is not held in a vertical plane but with its upper portion slightly inclined in the direction of arrow A (FIG. 1). Under the centrifugal forces of the swing-out phase the mercury body 18 moves in a labile state between the end positions 17*a* and 17*b* and emits switch-signals which block the emission of a "good" signal.

(vi) Highly incorrect backhand play:

In the starting position and/or through the swing-out phase the racket is held by the player in a manner such that the upper portion of the net deviates strongly from the vertical plane in the direction of arrow A (FIG. 1). The mercury body 18 remains steady in the end position 17*a* and centrifugal forces generated by the swing-out are insufficient to move the mercury body 18 toward the end position 17*b* in the switch 17. Therefore, no signal indicating the beginning of the forward strike will be emitted during the time interval Y and consequently, no "good" signal will be emitted during the entire forward strike phase.

The movability of the mercury in the glass body of the switch 7 or 17 can be empirically adjusted by the mercury switch manufacturer to the combination of holding the net in the racket head in the correct plane and the centrifugal forces generated by the swing-out of an individual player.

(III) The magnet track 12 and reed switches 14 and 15

(1) In the correct starting position the permanent magnet 13 is in the rearward end position 12*a* of the magnet track 12 and closes the reed 15.

(2) The swing-out phase, regardless of whether playing forehand or backhand, must not be carried out too fast, so that, during the upper or horizontal loop described by the racket during swing-out, the magnet 13 remains in the end position 12*a* closing the reed 15; swing-out must be slower than the subsequent forward strike. During the transition, if carried out rhythmically, there is no change until, during the time interval Y, acceleration of the racket toward full speed as the forward strike begins, moves the magnet body 13 forward and upward to the end position 12*b* in the track 12, in which the reed 14 is closed and reeds 15 opens.

If the forward strike is begun only after the time interval Y is over, the acceleration of the racket will come too late and the screen will not meet the ball with optimal speed and force.

If the forward swing-out is carried out too fast, the centrifugal forces generated thereby will be sufficient to move the magnet 13 forward to open the reed 15 and close the reed 14 although the player holds the racket handle with a correct angle relative to the vertical plane, and the lateral swing-out is also correct, being either upward or horizontally sideward. If this closing of the reed 14 happens while the time interval $X_1$ is not yet over, no "good" signal will result.

The same will happen, if the swing-out loop is downward instead of being horizontally sideward or upward.

(IV) Magnet switch 22 and reed switches 24 and 25

(1) In the correct starting position the permanent magnet 23 remains in the end position 22*b* of the switch 22 and closes both reeds 24 and 25.

(2) During swing-out, whether the player makes a forehand or a backhand strike, as well as in the following transition phase and forward strike, the position of the magnet 23 in the switch 22 will remain unchanged and reeds 24 and 25 will remain closed. Thus, regardless of whether a forehand or backhand are played, and whether they are played correctly or wrongly, the position of the magnet 23 will remain uneffected and reeds 24 and 25 will remain closed at all times. (Lines (2) and (f) in FIG. 7.)

(3) Correct service:

In order to make a service the player must turn the racket handle 2 in his hand by an angle of 180°. Consequently, in the starting position of service, the permanent magnet 23 is in the end position 22*a* of the switch 22 and the reeds 24 and 25 are both open. In this reversed position different capacitors of the circuit are switched in, which will prolong the time interval X automatically as shall be explained further below. From the starting position for service the player usually carries out a pendulum upward and downward swinging movement with the racket head 1 pointing generally downwardly. During this downward pendulum movement the mercury 8 in the switch 7 moves to the end position opposite the end 7*a* where it closes circuit between the pole pins 7*b* and 7*c*. This causes the time interval X to run. And then, the player swings the racket upward and rearward and continues rhythmically, without stopping to drop the racket behind his back, so that the control devie points toward the player's head with the player's hand reaching across his right hand shoulder. The racket must be at the player's back after the time interval X is over and the time interval Y begins to run, so that during the following upward swing (FIG. 4) the track of switch 22 adopts a reversed position with the track end 22*b* becoming the lower end, and the permanent magnet 23 will move into the end position 22*b* and close the reeds 24 and 25. This causes the buzzer 9 to emit a "good" signal which will sound until the player returns the racket into a starting position.

(4) Errors during service:

If the player hesitates and arrests the racket before or at an uppermost position during a service swing-out, the mercury body 8 in the switch 7 will move under centrifugal forces and/or gravity to the end position 7*a*, and the switch will be opened. There will then be no emission of a "good" signal.

If the racket is not dropped to the position behind the player's back but the player passes it from a position level with his head and immediately strikes downward with the racket for service, the magnet 23 remains in the position 22*a* and cannot close the reeds 24 and 25, so that no "good" signal can be emitted.

There now follows an integrated description of the functioning of all switches during the movements of forehand and backhand play and service, described generally hereinbefore, with reference to FIGS. 3 and 4 and in "control position" in which the player tests the operativeness of the control device according to the invention.

A. Operative control position

In this postion the player, who is assumed to be right-handed, holds the racket handle 2 in his right hand and lets his arm hang freely from his right shoulder. In this control position, after the on-off switch 6 has been moved to the control position C bridging posts 6.1*a* and 6.2*a*, the mercury 8 in the mercury switch 7 is in its outer, forward end position in which it closes the circuit between the pole pins 7*b* and 7*c*; moreover, the mercury 18 in the switch 17 bridges the central gap between the pole pins 17*a* and 17*b* of this switch and closes the same. In this position, the permanent magnet 13 in the first magnet track 12 is in outer position 12*a*, under its own weight; in this position 12*a* the reed 15 and therefore the circuit between the battery 5 and the buzzer 9 is closed, and the latter buzzes continuously, indicating that the battery has sufficient voltage and the entire circuit is operative. The player now sets a first time interval X by adjusting the capacitance of the circuit by means of the potentiometer 21 accordingly, as will be described further below.

B. Swing-out and forward strike control during forehand movement

B.1. Starting position:

The player now adopts the conventional starting position in which the player's right lower arm and the racket handle 2 enclose an angle of about 40° to 55° and optimally 45°. In this starting position the meshes of the racket head 1 shall extend in a vertical plane. The racket handle 2 must be gripped by the player accordingly. The circuit board 4 bearing the electrical elements on its outer face near the handle neck 3 is then in substantially vertical position and faces away from the player to the right. The switch 6 must be shiftes to "ON".

The mercury 18 in the mercury switch 17 is in the middle region between its inner and its outer position, if the racket in the starting position is held ideally so that the mesh in the head part 1 extends exactly vertically. A very slight tilting with its upper mesh portion toward the left is also permitted which would just suffice to move the mercury 17 in the mercury switch 18 toward its inner end position, i.e. the left position relative to the player.

B.2. Swing-out phase:

The player now swings the racket upward and toward the rear or horizontally toward the rear. At the moment when the swing-out movement begins, the mercury 8 in the mercury switch 7 is moved by the centrifugal forces into its outer forward position closing the switch (poles 7*b* and 7*c*) and remains in this position during the entire swing-out phase, and the mercury switch 7 thus signalizes the beginning of the swinging-back movement to the microchip 20 and causes the determined time interval X to run. (See also Line (a) in FIG. 7.)

Figure 7:
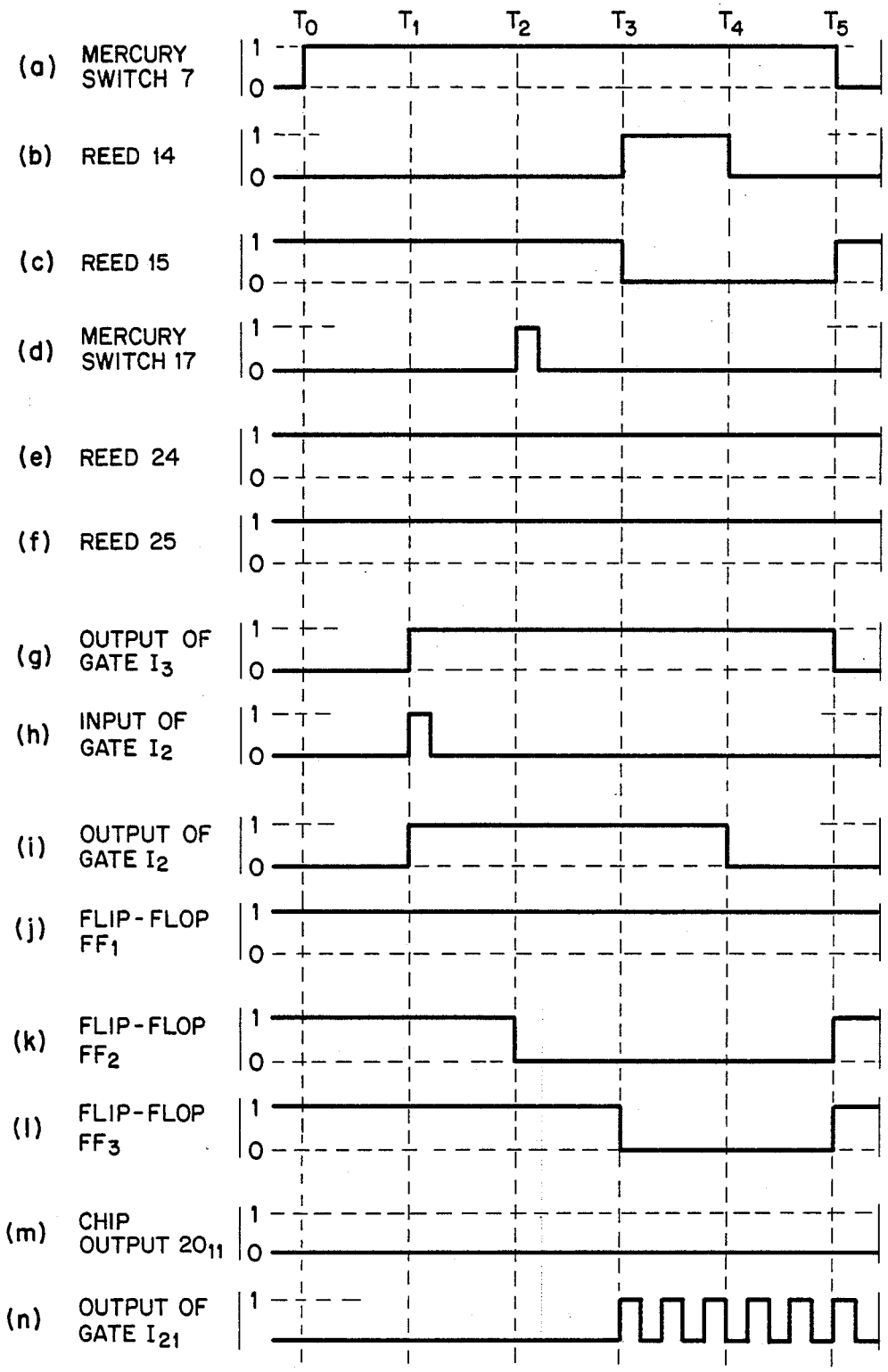
FIG. 7 is a pulse diagram showing the logic states of various electronic elements in the schematical circuit diagram of FIG. 5 during the phases of a player's entire forehand or backhand motion sequence as illustrated in FIG. 3.

As soon as the swing-out phase begins, the first permanent magnet 13 in the first magnet track 12 remains in its outer position 12*a*, closing the reed 15, and throughout that entire movement, the mercury 18 will remain in the inner end position 17*a* in the mercury switch 17 due to its inerta, and will interrupt the circuit activating the buzzer 9, so that no "good" signal is yet emitted (Lines (c) and (a) in FIG. 7.)

B.3. Transition to forward strike:

During the transition to the forward movement, the mercury 18 moves from its inner to its outer position in the mercury witch 17 and thereby, when briefly closing the switch, sends out a signal to the microchip 20 that forward movement has begun. Toward the end of the rearward swing-out movement, the time interval X must have ended and a new, shorter time interval Y is initiated via the microchip 20. If the racket is moved correctly by the player, the signal emitted by the mercury switch 17 to indicate the beginning of the forward strike must occur during that interval Y. If it occurs too early, i.e. during the time interval X, or if it occurs too late, i.e. after the time interval Y is over, the player's movements are in error, i.e. either too fast or too slow, during that phase. (Line (d) of FIG. 7.)

At the end of the swing-out phase the rearward movement is slowed down and reversed rhythmically to begin the forward strike from a lower level (FIG. 3 (3)) in a generally upward direction.

B.4. Forward strike phase:

During the forward strike the movement of the racket must be accelerated and the mercury 8 in the mercury switch 7 stays in its outer forward position closing the switch and the mercury 18 in the vertical mercury switch 17 moves to its outer end position 17*b*, both mercury bodies moving under centrifugal forces. Concurrently, the magnet 13 in the first magnet track 12 will respond if the forward movement is carried out fast enough, i.e., the magnet 13 will move forward under centrifugal force, overcoming its inertia, and, while the reed 15 opens, the reed 14 will close the circuit between the battery 5 and the buzzer 9. During the remaining forward movement, the buzzer 9 will sound as long as the forward movement is carried out with sufficient speed, if all previous phases of the swing-out and transition to the forward strike had been carried out correctly. (Lines (b) and (c) of FIG. 7.)

B.5. Detection of errors:

The following errors, which have been described in connection with the individual switches shall now be briefly summarized as they might occur in the foregoing movements, described under B; they would prevent the emission of an acoustic or optical "good" signal:

(a) The starting position is in error. When the angle between the player's lower arm and the racket handle 2 is too large and the racket head is therefore too low, this will cause the mercury 8 in the mercury switch 7 to run from its inner end position, which it should occupy, toward its outer forward position which it should only adopt as the swing-out movement begins. The time interval X will start too early (Postion D in FIG. 1).

(b) When the player holds the racket too steeply, i.e. the angle between his lower arm and the racket handle 2 is too small, the mercury switch 7 will be prevented from responding to the swing-out movement, the mercury 8 being held all the time at its inner, rearward end position in the switch 7.

(c) When the angle at which the upper portion of the racket head 1 is held in the player's hand is such that it deviates to the right, relative to the vertical plane, as indicated by arrow B in FIG. 1, then the vertical mercury switch 17 will respond too early, because the mercury 18 will run to the outer, right-hand position 17*b* in the mercury switch 17 while the racket is still in starting position or during the swing-out movement.

(d) When the velocity of the swing-out movement which should be always less than the speed of the subsequent forward strike, is too high, i.e., the swing-out movement lasts too short a time, so that the transition to the forward strike begins before the time interval X has ended, the mercury switch 17 will signal the beginning of acceleration toward the forward strike already during the time interval X and not only later, during the time interval Y. Also, the magnet switch 12, 13 may respond too quickly.

(e) When the racket head 1 is lowered during the swing-out movement instead of remaining at least at the same horizontal level, this will cause the magnet 13 to respond by moving too early toward its inner, forward position which it should only adopt during the subsequent forward strike.

(f) When, after the swing-out phase is ended, the transition to the forward strike comes too late, i.e. the striking rhythm is interrupted, then the magnet switch 13 will move forward and close the reed 14 too late, i.e. only after the time interval Y has ended. The player's forward strike will not attain the required speed or attain it too late.

(g) If the swing-out movement is interrupted or is not carried out with the necessary dynamic force, the centrifugal forces may not be sufficient to hold the mercury 8 in the mercury switch 7 in its outer, forward position closing the switch.

Only the correct seizing of the racket handle 2 to move the meshes of the racket head 1 in a correct vertical or slightly inclined plane as indicated by arrow A in FIG. 1, during the swing-out phase as illustrated in FIG. 3, and the correct inclination of that plane, during the swing-out phase for a backhand strike, will leave the switching system in a stable zero-signal-position.

C. Backhand play

The starting position and all phases of the swing-out, transition and forward strike are the same as when playing forehand, except that the mercury switch 17 distinguishes between these two kinds of playing as described hereinbefore in connection with the functioning of the said switch.

D. Service

The response of the switch elements to the sequence of movements during the service shall now be explained having reference to the earlier description of service phases in connection with FIG. 4.

In the upside-down position of the circuit board 4, resulting from the service starting position, the mercury 8 in the mercury switch 7 must again be in its inner position 7*a*, and the permanent magnet 23 in the second magnet track of switch 22 has moved, under its own weight, to the opposite track end 22*a*, thereby opening the reeds 24 and 25. Thereby, the service program is automatically initiated. The starting position of the racket is shown in FIG. 4 to be slightly different from that of FIG. 3.

Concurrently with opening of the reeds 24 and 25 by the magnet 23, the mercury switch 7 is also activated and sends a signal to the microchip 20 which starts the time interval $X_2$. The time interval $X_2$ begins to run and is automatically lengthened by increasing the capacitance, as the swing-out in a service strike should take longer than in the forehand or backhand strike. As the racket moves during the service swing-out from a downward to an upward movement (FIG. 4 (*g*)) and downward again to behind the back of the player, the mercury switch 7 and the magnet 23 shift again to their opposite end positions. After the end of the swing-out the time interval $X_2$ is at an end and the racket should be behind the player's back (FIG. 4 (*h*)). The time interval Y now starts automatically. In the swing-out phase of the service toward a position of the racket behind the player's back, the racket is swung upward and then downward, and the magnet 23 moves in the track 22 to activate the reed 24 and 25. At the same time, the mercury 8 moves to its inner, downward position in the mercury switch 7 and in doing so, sends out a signal that the downward strike (FIG. 4 (*j*)) begins.

In the rhythmically following downward strike of the racket which must begin during the time interval Y in order to be carried out correctly, the positions of the mercury switch 7 and the magnet 23 remain unchanged under the influence of centrifugal forces, while the mercury 18 in the vertical mercury switch 17 moves to the outer end 17*b* of the switch and sends out a signal to the microchip 20, that the downward strike phase of the service has begun and is in progress. The magnet 13 in the first magnet track 12 remains in its forward position 12*b* closing the reed 14. Therefore, during the downward movement of the strike phase of the service, the buzzer 9 emits an acoustic signal. No such signal will be emitted if the player made an error at any time during the service. Such errors can be the following:

(a) The starting position was not correct. For instance, if the upper end of the racket was not turned sufficiently as indicated by the arrow D in FIG. 1, and/or the racket handle 2 is held at too large an angle with the player's lower arm, the mercury 8 in the mercury switch 7 may have been in its outer position 7*b* (see I (2) supra).

(b) An excessively sideward swing-out during the service swing-out phase, as indicated by arrows E or F in FIG. 1, instead of a more downward movement as indicated by arrow V (FIG. 4), will cause the swing-out phase to be too short and the reeds 24 and 25 will be activated by the magnet 23 before the time interval $X_2$ has ended, while such activation of the reeds 24 and 25 should take place later during the time interval Y.

(c) The racket head 1 will not be guided behind the player's back, so that reeds 24 and 25 will not become activated.

(d) The swing-out movement in service is interrupted during the upward swing, before the racket head 1 has been guided behind the player's back, so that either the mercury switch 7 will open, i.e. the mercury 8 will move to its inner position 7*a*, or, due to insufficient rhythmics of the service swing-out, the time interval $X_2$ is too short.

(e) If, with the racket head 1 pointing downwardly while the racket is being held behind the player's back, the player hesitates or delays initiating the strike phase, the reeds 24 and 25 may become activated too late by the magnet 23, after the time interval Y is already over.

(f) In an erroneous starting position, the player has gripped the racket handle 2 in such a manner that the upper portion of the racket head 1 is inclined too much in the direction of the arrow A (FIG. 1) and the mercury switch 7 and the magnet switch 23 will not be in their correct positions described hereinbefore, namely the mercury 8 in position 7*a* and the magnet 23 in position 22*a*.

In FIG. 5, the gates $I_1$, $I_2$, $I_3$, $I_5$, $I_6$ and $I_{20}$ are AND-gates, the gates $I_4$ and $I_7$ are OR-gates (inverters). Electrical elements $I_{18}$ and $I_{19}$ are field effect transistors (FET), preferably of the insulated FET, enhancement type, single channel, P-type channel with brought-out substrate connection.

Flip flop FF1 is constituted by gates $I_9$ and $I_{10}$, flip flop FF2 by gates $I_{11}$ and $I_{12}$, and flip flop FF3 by gates $I_{15}$ and $I_{16}$.

The multivibrator comprises as constituents the NOT-gate $I_{17}$, the FET's $I_{18}$ and $I_{19}$, and, in series connection, from the brought-out substrate connection of the FET $I_{18}$, to the chip pin $20_{14}$, the AND-gate $I_{20}$ and the NOT-gate $I_{21}$.

In FIG. 7, various electronic elements are shown in one of the logic states 0 and 1, as it is adopted by them at the following times:

$T_0$=time of beginning the forehand or backhand sequence of motions out of a correct starting position; beginning of time interval $X_1$;

$T_1$=time of ending interval $X_1$ and beginning time interval Y;

$T_2$=time of mercury switch 17 signaling the beginning of the forehand strike;

$T_3$=time when forehand acceleration shifts the magnet 13, opening reed 15 and closing reed 14; a "good" signal begins to be emitted;

$T_4$=time of interval Y ending, it would be too late for the mercury switch 17 to send out a signal now;

$T_5$=the fade-out of the forward strike stops, the racket is lowered and returned to a starting position.

The lines (a) to (n) in FIG. 7 indicate the logic states of the following electronic elements:

Line (a): mercury switch 7
Line (b): reed 14
Line (c): reed 15
Line (d): mercury switch 17
Line (e): reed 24
Line (f): reed 25
Line (g): output of gate $I_3$ inside chip 20
Line (h): input in gate $I_2$; chip inputs $20_5$ and $20_6$
Line (i): output of gate $I_2$
Line (j): flip flop FF1

Line (k): flip flop FF2

Line (l): flip flop FF3

Line (m): common input in gates $I_4$ and $I_5$; chip input $20_{11}$

Line (n): output from gate $I_{21}$; chip output $20_{14}$.

The type of gate used is shown in FIG. 5 in accordance with a conventional symbology (see International ElectroTechnical Commission Publication 113-7 (1981).

The operation of the schematical circuit diagram shown in FIG. 5 shall now be explained having reference also to the circuit elements and wiring shown in FIGS. 2 and 6 and to the pulse diagram of FIG. 7.

(K) Starting position:

In the starting position the switch 6 is turned to "ON", i.e. the posts 6.1.*c* and *d.* and 6.2.*c* and *d.* are closed. In this starting position of the control apparatus, the reeds 15, 24 und 25 are closed and the mercury switches 7 and 17 and the reed 14 are open. (Lines (a) to (f) of FIG. 7.)

The pulldown-resistors 26*b, c, d* and *e,* the resistor 32, via the diodes 34 and 37, respectively, and the resistors 42 draw all chip inputs to low (O-potentials) i.e., the internal gates $I_1$ through $I_7$ have at their exits logic O (low). Consequently, the flip-flop FF1 constituted by gates $I_9$ to $I_{10}$ is prepared for setting and resetting, while the flip-flop FF2 constituted by the gates $I_{11}$ and $I_{12}$ is reset via the inverting gate $I_8$ by way of its exit which is at logic 1 (+supply voltage), i.e. its exit leads logic 1. Thereby, the flip-flop FF3 constituted by the gates $I_{15}$ and $I_{16}$ is reset, the exit of flip-flop FF3 being logic 1, and this causes the multivibrator, consisting of the two field electrical transistors (FET) $I_{18}$ and $I_{19}$ and the gates $I_{17}$, $I_{20}$ and $I_{21}$ to be blocked. (FIG. 7, lines (j,k,l,n.)

(L) Beginning of the swing-out phase, playing forehand or backhand:

The mercury switch 7 closes (FIG. 7, line (a) time $T_0$) and the capacitor 40 is charged up via resistors 38 and 39 and the potentiometer 21, reed 24 being closed, and after the charging time $X_1$ of the capacitor 40, the gate $I_3$ goes to logic 1. (FIG. 7, line (g) time $T_1$). The voltage from switch 7 is applied to the exit of the gate $I_3$ as the time $T_1$, and time interval $X_1$ is over. If, during the following interval Y, the switch 7 should open and close again, due to wrong handling of the racket, the time interval Y would be interrupted and restarted each time this happended. Therefore, a continuing, rhythmic motion must be maintained to prevent the switch 7 from opening.

As a consequence of correct play, simultaneously:

flip-flop FF2 is being prepared for setting;

flip-flop FF1 is set, whereupon the gate $I_{15}$ is prepared for passing on a pulse from gate $I_1$;

the positive slope of the gate $I_3$ is transferred via the capacitor 41, (FIG. 7 line (h), time $T_1$) charging the capacitor 44, to the gate $I_2$. Time interval Y begins (see FIG. 7, line (i) time $T_1$). The gate $I_2$ is maintained during the time interval Y, formed by the capacitor 44 and the resistor 43 determining the discharging time from gate $I_2$ (FIG. 7, line (i), time $T_4$). During the time Y, the reed switch 17 must set the flip:flop FF2 by means of a pulse (FIG. 7, lines (d) and (k), time $T_2$).

The reed 15 must stay in logic state 1 (ON) (FIG. 7, line (c), time $T_2$) until after switch 17 has emitted the pulse, otherwise there would be no pulse. As the reed 14 is closed, reed 15 will open (FIG. 7, lines (b) and (c), time $T_3$).

It is important that the reed 25 remains in the logic state 1 (i.e. ON) if it does not, the switch 17 cannot emit the necessary pulse at time $I_2$. (FIG. 7, compare lines (d) and (f), see also FIG. 5). Reed 24 must be closed (logic state 1) because of the length of the time interval $X_1$ is dependent thereon, but its state would not effect the function of switch 17.

When the flip-flop FF2 is set by that pulse, flip-flop FF3 will be prepared for setting via gate $I_{14}$ and will go to logic 0 within the time Y. The reed 14 then sends a signal logic 1 which is transferred via the gates $I_1$ and $I_{13}$ to the flip-flop FF3; the flip-flop FF3 is then set, and the multivibrator is working, emitting a buzzing or chirping sound. (FIG. 7, lines (b), (l) and (n), time $T_3$.)

If the logic state at chip inputs 10 and 11 were not in logic state 0 (FIG. 7, line (m), then the flip-flop FF2 could not drop to logic state 0 at the time $T_3$ in response to the closing of the reed 14 (FIG. 7, lines (b) and (l), time $T_3$) and the multivibrator would not work.

(M) Sources of errors:

(a) At the start:

The switch 17 is activated prior to the time $X_1$ and after the closing of the mercury switch 7. The pulse from the latter is stored via the diode 36 by means of the capacitors 35 and resets the flip-flop FF1 via the gates $I_4$ and $I_7$. Consequently, the gate $I_{13}$ is blocked and no setting of the flip-flop FF3 is possible, and consequently no "good" signal will be emitted.

(b) Interruptions during the forehand or backhand movements will lead to the emission of pulses by the mercury switch 17 as the mercury switch 7 will also open and the time $X_1$ will begin to run anew.

(c) The racket head 1 is held too low:

The reed 15 will open too early, prior to the beginning of the time interval Y, and no pulse can be emitted from the mercury switch 17 (see further under Error (a).

(d) The racket head 1 will be permitted to point downward, whereby the reed 25 opens and the reed 17 is deactivated.

(e) The net in the racket head 1 is shifted with its upper portion away from the vertical plane strongly in the direction of arrow B (FIG. 1). The inertia of mercury 18 in the switch 17 will then prevent the emission of a pulse during the time Y, which will pass directly to the gates $I_8$ and $I_7$, i.e. the flip-flop FF2 is not set and the flip-flop FF3 remains reset.

(f) The swing-out phase is executed too fast:

This leads to the same consequences as the error (c).

(N) Service

The control apparatus is turned upside down, so that the mercury switch 17 plays no part in the control and the reeds 24 and 25 are open; consequently the time interval $X_2$ will be longer, as the capacitor 40 is only charged via the resistor 38 and the potentiometer 21, but (reed 24 being open) no longer via the resistor 39. At the beginning of the swing-out, the mercury switch 7 will close and the same operation is repeated as described above under (L).

Precondition:

The reed 25 must close during the time interval $X_2$ as the flip-flop FF1 is set; during the time $X_2$ the reed 25 will transmit a pulse via the gate $I_5$ which has been prepared by the $X_2$ time signal from the mercury switch 7, and the pulse is transmitted by the signal logic 1 in the time interval Y, and via the gate $I_8$ to the flip-flop FF2 which is set thereby; the flip-flop FF3 is then prepared, in the same sequence of operations as in the forehand or backhand swingout, for setting via gate $I_{14}$ and will close within the time Y; the reed 14 then sends a signal logic 1 which is transferred via the gates $I_1$ and $I_{13}$ to the flip-flop FF3 which is then set, the multivibrator then working with emission of a buzzing or chirping sound.

(O) Control operation:

In the switch 6 the poles 6.2.*a.* and *b.* are bridged with 6.1.*a.* and *b.* to close the switch for control. The mercury switch 7 then closes with the same consequences as described above under (L), after the end of the time interval $X_1$, the signal logic 1 from the gate $I_1$ sets the flip-flop FF2 via the switch position 6.*a* and the gate $I_8$; there results a resetting level and the flip-flop FF3 will be reset and thereby prepared for new setting, and logic 1 of gate $I_1$ can set the flip-flop FF3 via the gate $I_{15}$.

Figure 8:
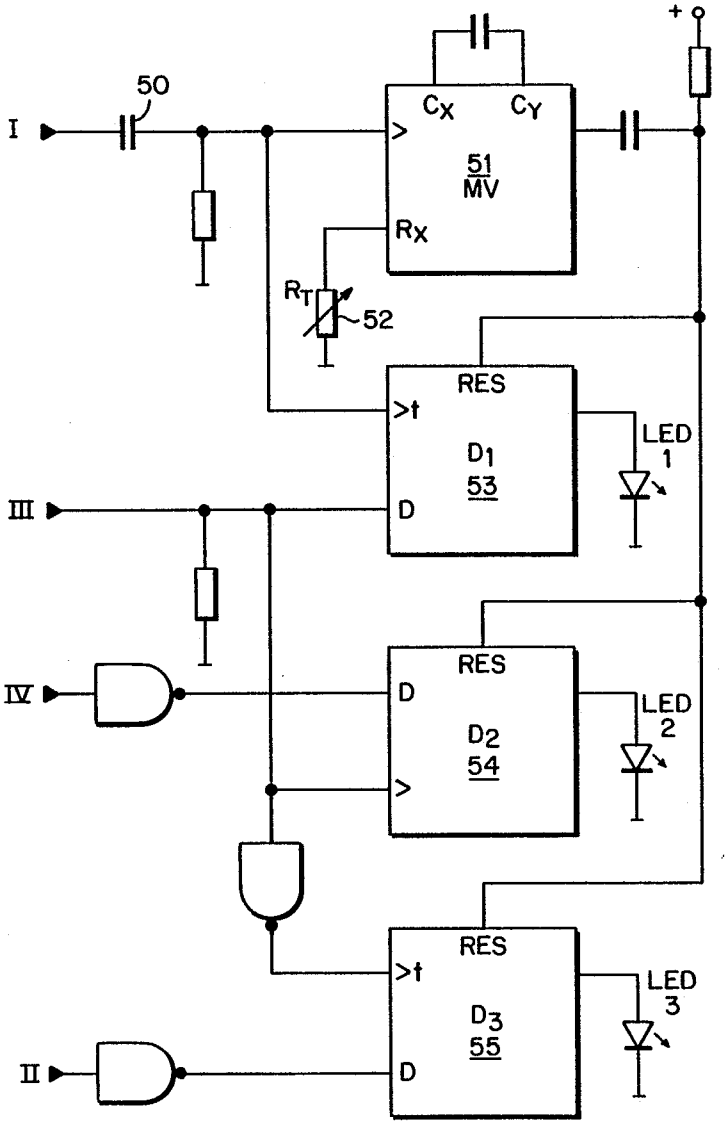
FIG. 8 shows an auxiliary circuit for producing an optical signal indicating a faulty execution of various phases of a movement by the player.

In FIGS. 5 and 8, the symbols I, II and II signify points at which certain voltage levels prevail. Thus "I" means the voltage level of the pulse generated when the switch 7 closes making contact between poles 7*b* and 7*c;*

"II" means the voltage level prevailing at the pin 8 of the integrated circuit 20, which level corresponds to $t_y$;

"III" means the voltage level generated by the swishing contact at the mercury switch pole 17*b;* and "IV" means the voltage level at the pin 2 of the integrated circuit 20 which level corresponds to the time interval $t_x$.

This will permit optimal storing and recall of faulty motions made by the player in carrying out the various sequences of phases described in detail hereinbefore.

The positive pulse which is generated at the beginning of the swing-out movement by the closing of the mercury switch 7 (see FIG. 7) starts, via the post I (FIG. 5) and a capacitor 50 (FIG. 8), the monoflop 51 which generates a negative pulse as soon as a time interval X being adjusted by the potentiometer 52 is oven, which negative pulse resets the storage flip-flops to "zero" state.

Additionally, the above-mentioned positive pulse generated by the mercury switch 7 serves as storage pulse for the voltage level at the post III. A faulty movement consisting of a wrong holding of the racket at the beginning of the swing-out movement will be signaled by means of the light-emitting diode LED 1 (FIG. 8). The positive flank of the pulse at post III will in turn lead a storing of the level at post IV by the D-flip-flops 53,54 and 55 whose light-emitting diodes LED 1, LED 2 and LED 3 will indicate a twisting displacement of the racket head 1 during the swing-out motion.

The negative flank of the pulse at point III causes the flip-flop 55 to store the level of the voltage at post II. A wong level will lead to the signal "swing-out movement interrupted" by glowing of the light-emitting diode LED 3.

The visual signals emitted by the LED's 1, 2 and 3 need not be observable by the player as this might lead to errors on his part, but by a teacher who will thus realize where his pupil makes mistakes.

Figure 9:
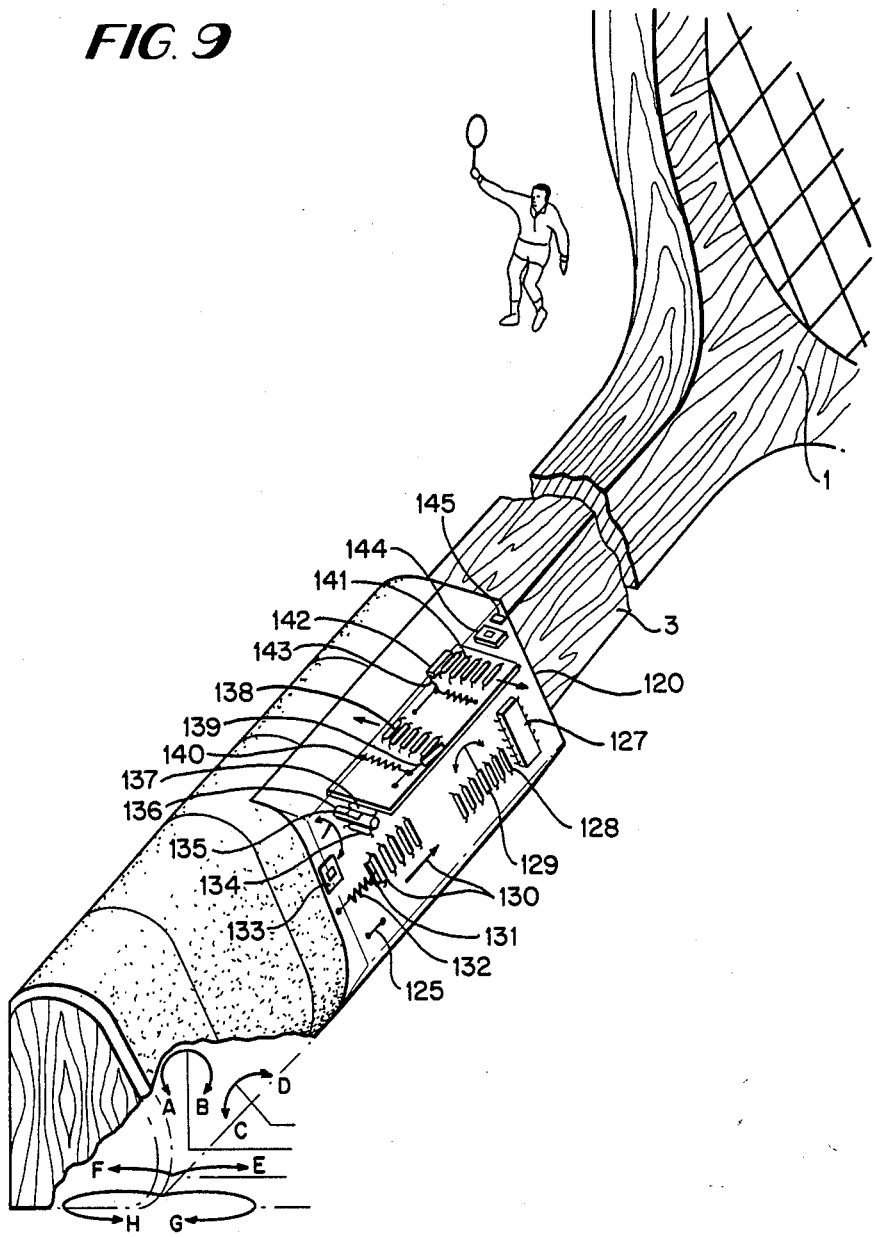
FIG. 9 shows in perspective view and schematically another embodiment of the apparatus according to the invention built into the handle of a tennis racket and with the cover of the apparatus housing removed.

In the embodiment of the apparatus according to the invention shown in FIG. 9 the apparatus housing 120 is built in the racket arm 2 in the same manner as in the embodiment shown in FIG. 1. By removing the cover of the housing there are visible on the outwardly facing side of the circuit board 125 a microprocessor and analog digital converter 127 (known per se);

reed switches 128 which have two functions, namely (a) to program and control the position of the racket head 1 as held by the player as well as the starting position, (b) to program the swing-out movement of the service and the starting position therefor;

a shiftable magnet 129 for actuating the reeds 128;

reed switches 130 for programming and controlling the swing-out motion, the speed of swing-out, the velocity of hitting and registering any interruption of the hitting rhythm in playing forehand or backhand as well as in service;

a magnet 131 for actuating the reeds 130;

a tension spring 132 for restoring the magnet 131 to its initial position and limiting its length of travel;

a buzzer 133 for signaling acoustically a correct or a faulty execution of a movement;

a first reed switch 134 for programming and controlling the holding of the racket handle during transition from a swing-out to a hitting motion;

a second reed switch 137 for the same functions as the reed switch 134;

a magnet 135 for actuating the reed switches 134 and 137;

a track 136 for the magnet 135;

reed switches 138 for programming and controlling the swing-out motion when beginning a forehand play and the subsequent hitting motion (in the case of a right-handed player, for a left-handed player, the reeds function in the opposite sense);

a magnet 139 for actuating the reed switches 140;

a compression spring 140 for limiting the length of travel of the magnet 139 and restoring it to its starting position;

reed switches 141 for programming and controlling the swing-out move at the beginning of a backhand play and the subsequent hitting motion (see note concerning right-handed and left-handed players, supra);

a magnet 142 for actuating the reed switches 141;

a compression spring 143 for limiting the length of travel of the magnet 142 and restoring the same to its initial position;

a selector switch 144 for switching from programming to controlling and viceversa; and a switch 145 for controlling the normal programed sequence of motions in a strike.

Programming and Controlling the Execution of the Program

On the basis of a single chip microprocessor 127 optionally comprising as a store, e.g. an analog-digital converter present in the circuit according to the invention, the apparatus is programmable for all sequences of motions which are schematically illustrated in FIGS. 3 and 4 and can control the execution of the program and signalize whether a sequence of motions is carried out correctly or in a faulty manner by the player. In particular, the program can be entered in the store and the execution of this program can then be controlled taking into account the anatomy of a player. As single-chip microprocessor, a Eurotechnique ETL 9411 can be used.

When, during the execution of a forehand movement by a right-hand player, the beginning of the swing-out phase at (a) is signalled to the chip 20 for processing and there results a signal from the mercury switch 17 timely within the interval Y this is likewise recorded in the store. All subsequent changes in the electronic circuit as described above are likewise recorded therein. In the sequence of motions illustrated in FIGS. 3 and 4 the electronic circuit will evaluate the phases of motion as to being "good" or "faulty".

All executions differing significantly from the ones illustrated in FIGS. 3 and 4 will be evaluated as "faulty".

In the case of a left-handed player the situation is identical. The response of the electronic circuit to a left-handed forehand play will be the same as that to a right-handed backhand play and viceversa.

The same applies to the service (FIG. 4) in which the time interval $X_1$ is increased to $X_2$. The same electronic evaluation as in the case of a forehand or backhand play will take place taking into account the longer interval $X_2$.

At the lower end of the racket handle the directions of movement A to G of the handle have been indicated as shown in FIGS. 1 and 9.

While the circuit diagram shown in FIGS. 2, 5 and 6, and optionally in FIG. 8 is to be used for the execution of fixed programs in accordance with theoretical teaching methods in ball games, the apparatus embodiment of FIG. 9 can be used with a microprocessor 127 instead of the microchip 20, mentioned above as well as additional programmed motion sequences which can take into account other differing teaching methods as well as individual inputs.

A corresponding pre-programmed teaching method was already loaded into the microprocessor 127. An increased number of switches of individual functions which control the motion phases of the bat or racket make an additional phase variation of the program storable in the microprocessor 127 and readable out of the latter into the control circuit.

The program can always be entered anew, after the preceding, additionally set program has been cleared.

In the control circuit mounted in the housing 120, the switches described above are arranged geographically in a manner such that the pulses described hereinbefore (FIG. 7) are generated and transmitted in accordance with the sequence of motions as described hereinbefore in connection with the embodiment of FIGS. 1 and 2.

In both embodiments the tracks of the magnets actuating the reed switches are arranged corresponding to the directions of correct movement of the racket. Thus, the mercury switch 17 is disposed vertically to the circuit board plane in order to control the velocity of the strike executed by the player.

Desired variations of the program can be recorded in the store or the microprocessor 127 whenever desired, after the previously entered additions to the program have been cleared, while the basic theoretical program is preserved at all times.

In executing a program with control by the embodiment shown in FIG. 9, the starting position of the racket for service is that in the small picture of a player in FIG. 9. The actuable elements in the circuit are those shown in FIG. 9. The switch 144 is shifted to "programming".

After the beginning of the swing-out phase of the service the various pulses generated by the switches are entered into the current clock pulse of the microprocessor 127 and stored in the latter, so that the stored information can be retrieved later as control function.

During the swing-out phase in the direction E the magnet 131 is moved toward the reed switches 130. Depending on the swing-out acceleration one or several or all of these switches 130 are closed. At the same time, the magnet 139 is moved in the direction of its arrow toward the reed switches 138 and controls the direction of the swing-out motion. Moreover, the magnet 135 remains in its end position in the track 136 as long as the racket handle is gripped correctly by the player's hand.

The length of travel of the magnet 139 actuating the switch 138 is entered into the microprocessor 127 and thereby programs the length of the swing-out phase. The magnet 129 actuates the reed switches 128 and thereby enters into the program the positioning of the racket during the entire swing-out phase, and also during the subsequent ball-striking phase.

After the swing-out phase the racket passes into the ball-hitting or striking phase, being moved in the direction G (FIG. 9) whereby centrifugal forces in combination with the action of the restoring spring 140 return the magnet 139 to its starting position (opposite to the direction of its arrow).

With the beginning of the ball-hitting strike in the direction of the arrow G, the magnet 142 actuates the reed switches 141 which store this motion in the microprocessor 127 and thereby enter it into the program.

The speed at which this ball-hitting strike is carried out is recorded depending on the number of reed switches 141 actuated by the magnet 142.

The length of time, during which the reed switches 141 are actuated, and correspondingly the length of the pulse generated by them, enter into the microprocessor 137 the length and duration, i.e. the speed of the ball-hitting strike.

By entering this program or a similar one, the microprocessor 127 can be loaded and can read it out, after shifting the switch 144 to "controlling".

The entered program can then be retrieved to control the manner in which a subsequent sequence of motions by a player reproduces the same.

In order to record a program for backhand play by a right-handed player, in accordance with a swing-out motion in the direction of arrow F and a subsequent hitting motion in the direction of arrow H, the reed switches 138 and 141 are actuated in the reverse manner to that during forehand play described above. The position of the magnet 135 relative to reed switches 137, taken in the direction of the arrow A takes over generation of the same preliminary pulse (pretrigger), at the beginning of programming, which was generated for programming the forehand play.

The position of the magnet 135 relative to the reed switches 134, taken in the direction of the arrow B, generates, at the beginning of programming, the pretrigger (preliminary pulse) for programming the backhand play.

These two positions are also requested from the microprocessor 127 during its "control" phase.

In a similar or varied manner, but in accordance with the principal programming method described hereinbefore, there can be programmed all different kinds of strikes including servicing the ball, and can be recalled during the "control" phase, not only in playing tennis, but also in other kinds of ball games involving use of a bat.

I claim:

1. An apparatus for programming and controlling the seizing of a hangle of a ball-hitting instrument and the guiding of the instrument by a player during striking of a ball in a ball game, comprising:

(a) an apparatus casing;

(b) a housing therein for a source of electric direct current;

(c) an electronic circuit mounted in said casing and comprising:

(c.1) a circuit board having a longitudinal axis, a first and a second edge transverse to said axis, and an outer and an inner board face;

(d) on-off-switch means mounted on said casing and for turning direct current from said current source on and off;

(e) perceivable signals-emitting means;

(f) integrated circuit chip means for being programmable for controlling a first time interval (X) of adjustable duration and a second time interval (Y) of fixed duration following directly upon said first time interval;

(g) potentiometer means for adjusting the duration of said first time interval;

(h) a first noiseless quick-response elongated switch, having an inner and an outer contact end and being mounted on, and extending parallel with, said outer board face of said circuit board and forming an angle of about 40° with said longitudinal board axis, said outer contact end of said first switch being nearer said first transverse board edge than said inner first switch contact end;

(i) a second noiseless quick-response elongated switch, having an inner and an outer switch end and being mounted at said inner switch end on said outer board face, projecting therefrom at a substantially right angle;

(k) a third elongated switch, being mounted on said circuit board and having an outer end and an inner end, said inner end being nearer said first transverse board edge than said outer third switch end; and (l) a fourth elongated switch having an inner end and an outer end and being mounted on said outer face of said circuit board, said outer end of said fourth switch being nearer said first transverse board edge than said inner fourth switch end.

2. The apparatus of claim 1, wherein said perceivable signals-emitting means has means for emitting acoustic signals.

3. The apparatus of claim 2, wherein said perceivable signals-emitting means is a buzzer.

4. The apparatus of claim 1, wherein:

said first and second switches are mercury switches;

said third switch is a magnetic switch comprising a first permanent magnet body and a track therefor having an outer and an inner third switch track end;

said fourth switch is also a magnetic switch, comprising a second permanent magnet body and a track therefor having an inner and an outer fourth switch track end;

said first magnetic switch comprising a first reed and a second reed, said first reed being closed and said second reed being open when said first magnet body is in position near said inner end of said third switch track, and said first reed being open and said second reed being closed when said first magnet body is in position near said outer third switch track end; and said fourth switch comprising a third and a fourth reed, both of said third and fourth reeds being closed when said second magnet body is in position at said outer fourth switch track end and being open when said second magnet body is at said inner fourth switch track end.

5. The apparatus of claim 4, wherein said first mercury switch is closed at least during said entire time intervals X and Y, when a mercury body therein is subject to a continuous centrifugal force.

6. The apparatus of claim 4, wherein each of said third and fourth switches comprises weighting means associated with said magnet body in a manner so as to accelerate movement thereof from one of the end positions thereof to the other, leaving open from one to three of the reeds associated with said two magnetic switches, and preventing sticking of said magnetic body adjacent said reeds.

7. The apparatus of claim 1, wherein said integrated circuit chip means is a gate-array chip.

8. The apparatus of claim 7, wherein said circuit means comprises, as a time-controlling unit, an AND-gate ($I_2$), two capacitors connected parallel with each other to the input of said AND-gate, and two resistors connected parallel with each other and with said capacitors to the input of said AND-gate, and said potentiometer means for adjusting the loading time of said capacitor to the length of the swing-out phase of a complete rhythmic motion sequence common to forehand as well as backhand play as well as a service motion sequence.

9. The apparatus of claim 7, wherein said first and second switches are mercury switches and said third and fourth switches comprise fly-weight circuit-making bodies.

10. The apparatus of claim 7, wherein said circuit means comprises electronic means for detecting and perceivably signaling transgressions of the motion sequences as determined by said time intervals (X) and (Y) due to incorrect playing.

11. The apparatus of claim 10, wherein said electronic means for detecting and perceivably signaling said transgressions are adapted for emitting optical signals.

12. The apparatus of claim 1, wherein said third switch extends parallel with said outer face of said circuit board and encloses an angle of about 20° with said longitudinal board axis; and said fourth switch extends parallel with said outer face of said circuit board and encloses an angle of about 75° with said longitudinal board axis.

13. A ball-hitting apparatus for playing ball games, comprising a handle having a longitudinal handle axis and a flat head part having a contact face for hitting a ball, means for programming and controlling the seizing of said handle and the guiding of said apparatus during a player's stroke for the purpose of hitting a ball, said means for programming and controlling, comprising:

(a) a casing;

(b) a housing within said casing for a source of electric direct current;

(c) an electronic circuit mounted in said casing and comprising:

(c.1) a circuit board having a longitudinal axis, a first and a second board edge transverse to said board axis, a first and second longitudinal board edge extending substantially parallel with said board axis, and an outer and an inner board face;

(d) on-off-switch means mounted on said casing and for turning direct current from said current source on and off;

(e) perceivable signals-emitting means;

(f) integrated circuit chip means for being programmed and controlling a first time interval (X) of adjustable duration and a second time interval (Y) of fixed duration following directly upon said first time interval;

(g) potentiometer means for adjusting the duration of said first time interval;

(h) a first noiseless quick-response elongated switch, having an inner and an outer contact end and being mounted on, and extending parallel with, said outer board face of said circuit board and forming an angle of about 40° with said longitudinal board axis, said outer contact end of said first switch being nearer said first transverse board edge than said inner first switch contact end;

(i) a second noiseless quick-response elongated switch, having an inner and an outer switch end and being mounted at said inner switch end on said outer board face, projecting therefrom at a substantially right angle;

(k) a third switch, having an inner and an outer contact end and being mounted on, said outer face of said circuit board, said inner end of said third switch being nearer said first transverse board edge than said outer third switch end; and (l) a fourth switch having an inner end and an outer end and being mounted on said outer face of said circuit board, said outer end of said fourth switch being nearer said first transverse board edge than said inner fourth switch end.

14. The ball-hitting apparatus of claim 13, wherein said apparatus is a tennis racket and said flat head part contains a racket screen as said contact face.

15. The ball-hitting apparatus of claim 14, wherein said electronic circuit is mounted in said handle with said longitudinal board axis extending substantially parallel with or coinciding with said longitudinal handle axis, said first transverse board edge is nearer said flat head part than said second transverse board edge, and said circuit board extends with its outer face substantially in the same plane as said racket screen, whereby, when holding said tennis racket with said racket screen extending in the vertical plane, and said first longitudinal board edge being above said second longitudinal board edge, said circuit is in position for controlling a forehand as well as a backhand sequence of motions, while, when holding said racket in the reverse position with said first longitudinal board edge being located below said second longitudinal board edge, said circuit is automatically in condition for controlling the sequence of motions during service of a tennis ball.

16. The ball-hitting apparatus of claim 13, wherein each of said third and fourth switches comprises weighting means associated with said magnet body in a manner so as to accelerate movement from one of the end positions thereof to the other, leaving open from one to three of the reeds associated with said two magnetic switches, and preventing sticking of said magnetic body adjacent said reeds.

17. The ball-hitting apparatus of claim 13, wherein said first and second switches are mercury switches;

said third switch is a magnetic switch comprising a first permanent magnet body and a track therefor having an outer and an inner third switch track end;

said fourth switch is also a magnetic switch, comprising a second permanent magnet body and a track therefor having an inner and an outer fourth switch track end;

said first magnetic switch comprising a first reed and a second reed, said first reed being closed and said second reed being open when said first magnet body is in position near said inner end of said third switch track, and said first reed being open and said second reed being closed when said first magnet body is in position near said outer third switch track end; and said fourth switch comprising a third and a fourth reed, both of said third and fourth reeds being closed when said second magnet body is in position at said outer fourth switch track end and being open when said second magnet body is at said inner fourth switch track end.

18. The ball-hitting apparatus of claim 13, wherein said integrated circuit chip means is a gate-array chip.

19. The apparatus of claim 18, wherein said electronic circuit means comprises, as a time-controlling unit, an AND-gate ($I_2$), two capacitors connected parallel with each other to the input of said AND-gate, and two resistors connected parallel with each other and with said capacitors to the input of said AND-gate, and said potentiometer for adjusting the loading time of said capacitor to the length of the swing-out phase of a complete rhythmic motion sequence common to forehand as well as backhand play as well as a service motion sequence.

20. The ball-hitting apparatus of claim 18, wherein said electronic circuit comprises electronic means for detecting and perceivably signaling transgressions of motion sequences as determined by said time intervals (X) and (Y) due to incorrect playing.

21. The ball-hitting apparatus of claim 20, wherein said electronic means for detecting and perceivably signaling said transgressions are adapted for emitting optical signals.

22. The ball-hitting apparatus of claim 13, wherein said third switch extends parallel with said outer face of said circuit board and encloses an angle of about 20° with said longitudinal board axis, and said fourth switch extends parallel with said outer face of said circuit board and encloses an angle of about 75° with said longitudinal board axis.

23. An apparatus for programming and controlling of the seizing position and the guidance of a ball-hitting instrument, said apparatus comprises an integrated circuit chip means, switching and controlling means for responding to a rhythmic motion sequence of the ball-hitting instrument, means for programming the rhythmic motion sequence of the ball-hitting instrument, means for controlling execution of a program, and means for producing a signal indicating at least one of the correct and incorrect rhythmic motion sequences of the ball-hitting instrument, whereby the complete sequence of motional phases during forehand play, backhand play and service of a ball with the aid of the ball hitting instrument are programmed as well as controlled by comparison with a master program produced with said apparatus, independently of whether the player is right-handed or left-handed.

24. The apparatus of claim 23, wherein said integrated circuit chip means is a single-chip microprocessor.

* * * * *